US005220315A

United States Patent [19]

Clerc

[11] Patent Number: 5,220,315

[45] Date of Patent: Jun. 15, 1993

[54] POWER SOURCE FOR DOT MATRIX LCD

[75] Inventor: Jean-Frederic Clerc, Yokohama, Japan

[73] Assignee: Stanley Electric Co., Ltd., Tokyo, Japan

[21] Appl. No.: 692,182

[22] Filed: Apr. 26, 1991

[30] Foreign Application Priority Data

May 1, 1990 [JP] Japan ..... 2-115600

[51] Int. Cl.[5] ..... G09G 3/36

[52] U.S. Cl. ..... 340/784; 359/55

[58] Field of Search ..... 340/784, 765; 359/55, 359/85, 89

[56] References Cited

U.S. PATENT DOCUMENTS 4,427,978 1/1984 Williams ..... 359/55 X
4,506,955 3/1985 Kmetz ..... 340/784 X
4,893,117 1/1990 Blomley et al. ..... 340/784

FOREIGN PATENT DOCUMENTS 52-53694 4/1977 Japan ..... 34/784

*Primary Examiner*—Ulysses Weldon
*Attorney, Agent, or Firm*—Frishauf, Holtz, Goodman & Woodward

[57] ABSTRACT

A dot matrix liquid crystal display having segment electrodes and common electrodes, a segment driver circuit and a common driver circuit, a multi-level power source, sensor resistors connected in series to the supply voltage bus lines for the segment electrodes, amplifiers for detecting and ampifying the voltage drop in the sensor resistors, and capacitors for capacitively coupling the common electrodes and the amplifiers. When the segment voltage is changed, the voltage change is sensed through the sensor resister and is fed back to the common electrode to reduce the induced noise on the common electrode.

8 Claims, 11 Drawing Sheets

COMMON SIGNAL

SEGMENT SIGNAL

PIXEL SIGNAL

COMMON SIGNAL

SEGMENT SIGNAL

PIXEL SIGNAL

SEGMENT SIGNAL

PIXEL SIGNAL ( CASE a )

POLAITY
REVERSAL ( P. R)
= 1 / FIELD ( CASE b )

P. R = 1 / FIELD ( CASE c )

P. R = 2 / SELECTION
TIME
= 2N / FIELD

COMMON SIGNL

SEGMENT SIGNAL

PIXEL SIGNAL

POWER SOURCE FOR DOT MATRIX LCD

BACKGROUND OF THE INVENTION

1. Field of the Invention

This invention relates to a power source for a liquid crystal display (LCD), and more particularly to a power source for a dot matrix LCD.

2. Description of the Related Art

In a dot matrix LCD, a plurality of row lines are disposed to cross a plurality of column lines, with intervening LCD cells. The cross points of the row and column lines constitute a dot matrix.

When a signal train for one row length, which is picture signals for one row line, is supplied to the column lines through a segment driver, one row line is selectively energized through a common driver. Thus, picture elements of one row line is displayed at one time. Row lines are successively energized to achieve display of a picture plane. The selection signal applied to the row line is called common signal and the picture signal applied to the column line is called segment signal. For example, when a liquid crystal cell is applied with a voltage above a certain value, it displays white. When the cell is applied with a voltage below the certain value, it displays black.

There is known pulse width modulation (PWM) method for displaying intermediate (gray) tones. During the selection time in which the associated row is selected, there are provided a white display period and a black display period, to display gray as an average. However, as the picture panel size becomes large, the selection time becomes short and the time constant associated with each LCD cell cannot be neglected. When the number of voltage level change is different for the cases of displaying black or white and an intermediate tone, it becomes difficult to perform a desired intermediate tone display.

There is a proposal that the common signal and the segment signal are changed their polarity once at each selection time so that the LCD cell experience the same number of polarity change irrespective of the tone of display.

There is also a kind of noise which is due to the capacitive coupling of the common electrode and the segment electrode. When the voltage of a segment electrode is changed, an induced voltage change also appears on the common electrode.

French Patent No. 2541027 (Application No. EN 8302494) discloses a compensating system which is effective for reducing the noise but requires three dummy electrodes in a cell. They are one common dummy electrode which serves as a noise sensor and two segment dummy electrodes which receive the signal supplied from the sensor after inversion and amplification. The area of the segment dummy electrodes should not be reduced less than 1/10 of the active region of the cell. Thus, this compensation cannot be said to be adapted for all the types of display.

French Patent No. 2493012 (Application No. EN 8022930) and French Patent No. 2580110 (Application No. EN 8505146) do not employ the PWM method. The gray level is provided by sequentially supplying white or black signals of different length. This drive method is appropriate when the number of gray levels is about 10 or 16. This drive method requires drivers and controllers which can act at high frequencies. Thus, it cannot be said that this system is fitted for any types of display.

SUMMARY OF THE INVENTION

An object of this invention is to provide a power source for a dot matrix LCD of improved visual performance.

Another object of this invention is to provide a power source for a dot matrix LCD capable of performing gray tone display or color display.

Further object of this invention is to provide a power source for a large size dot matrix LCD of reduced noise.

DESCRIPTION OF THE PREFERRED EMBODIMENTS

Preceding the description of the embodiments of this invention, some related conventional arts will first be described for enhancing the understanding of this invention.

Conventional Addressing Mode

The dot matrix liquid crystal display of the conventional type is driven by such signals as shown in FIG. 4 from the common driver and the segment driver applied to the rows and columns of the matrix.

Common Signal

Figure 4A:
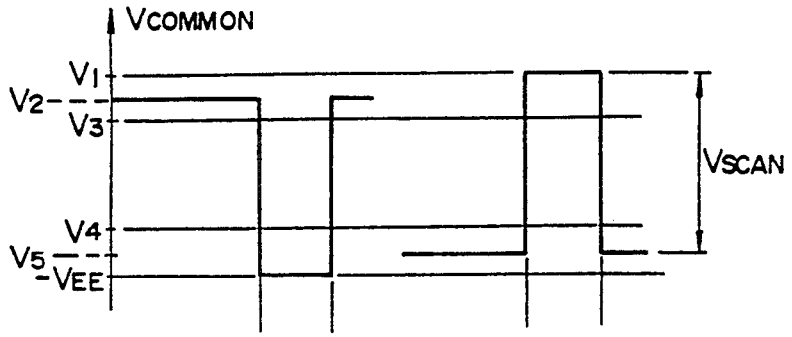
FIG. 4(A) (PRIOR ART)
FIGS. 4(A), 4(B) and 4(C) show voltage waveforms applied to a dot matrix liquid crystal display according to a conventional addressing mode using a 6-level power source.

The common signal is a sequential signal for a plurality of rows and is a constant pattern signal for each row irrespective of the picture signal for displaying a picture. Namely, the common signal which is the signal applied to the row takes the maximum value (−VEE in the first field and V1 in the second field) for a period $\tau R$, called row selection time, as shown in the waveform of FIG. 4(A). The position of the selection time $\tau R$ varies according to the position of the row.

The selection time $\tau R$ is a small fraction the total field period $\tau F$. For example, when the number of rows to be successively scanned is N, $$\tau F = N \times \tau R.$$

For example, $\tau F = 20$ msec, $N = 400$, and $\tau R = 50$ μsec.

During the non-selection time, i.e. outside the selection time, the signal applied to the row takes V2 in the first field and V5 in the second field. The voltage swing V2−(VEE) and V1−V5 is denoted as VSCAN. Here, the voltages V2 and V5 are reference voltages and the segment signal varies between two voltages V1 and V3; and V4 and −VEE) sandwiching these reference voltages, depending on the pattern to be displayed.

Segment Signal

Figure 4B:
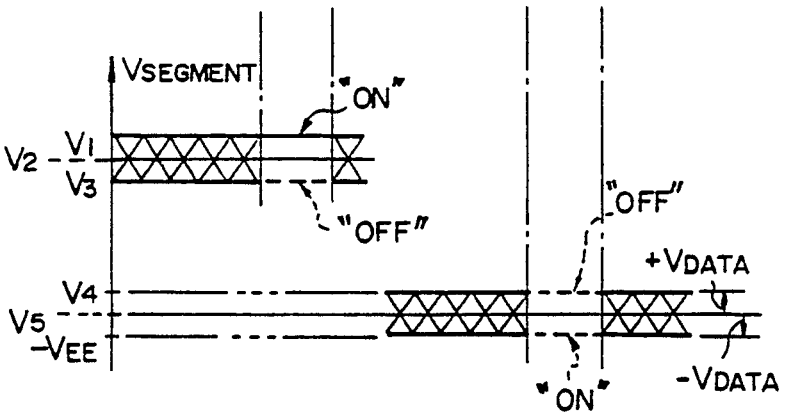
FIG. 4(B) (PRIOR ART)

The segment signal depends on the picture to be displayed. As shown in the waveform of FIG. 4(B), the segment signal takes V1 when the segment signal is "on", and V3 when the segment signal is "off", in the first field. Here, it is convenient to denote V1 as V2+VDATA and V3 as V2−VDATA. During the second field, the segment signal is −VEE when the segment signal is "on" and V4 when the segment signal is "off". Here, it is also convenient to denote −VEE as V5−VDATA and V4 as V5+VDATA. Here, except the selection time $\tau R$, the segment signal may either V1 or V3, and −VEE or V4. This arbitrariness is shown by the crossed hatching.

Pixel

The signal applied to the pixel corresponds to the voltage difference between the segment signal applied to the column line and the common signal applied to row line.

$$VPIXEL = VSEGMENT - VCOMMON.$$

During the row selection time, pixels receive signals of large absolute value, which value also depends on the level of brightness to be displayed.

In the first field:

$$\begin{aligned} VPIXEL\ \text{"on"} &= V1 - (-VEE) \\ &= V2 - V5 + 2VDATA \\ &= VSCAN + VDATA \end{aligned}$$

(when the pixel white) and $$\begin{aligned} VPIXEL\ \text{"off"} &= V3 - (-VEE) \\ &= V2 - V5 \\ &= VSCAN - VDATA \end{aligned}$$

(when the pixel is black).

In the second field:

$$VPIXEL\ \text{"on"} = -VSCAN - VDATA$$

(when the pixel is white) and $$VPIXEL\ \text{"off"} = -VSCAN + VDATA$$

(when the pixel is black).

The value of square of the pixel signal are the same for the first and the second fields, $$(VPIXEL\ \text{"on"})^2 = (VSCAN + VDATA)^2$$

$$(VPICEL\ \text{"off"})^2 = (VSCAN - VDATA)^2$$

During the non-selection time, the pixels receive signals depending on the pattern to be displayed in the other selection rows.

$$VPIXEL\ \text{"on"} = VDATA \text{ or } -VDATA$$

$$VPIXEL\ \text{"off"} = VDATA \text{ or } -VDATA$$

The value of the square of the pixel signal does not depend on the sign of the signal. Therefore, the square of the pixel signal is always $$(VPIXEL)^2 - (VDATA)^2.$$

Let us consider the root mean square (rms) voltage of the pixel signal along all the frame, when the number of the total scanning line is N.

$$\begin{aligned} (VPIXEL\ \text{"on"})_{rms} &= \{(1/N)(VSCAN + VDATA)^2 + (N-1)(1/N)(VDATA)^2\}^{\frac{1}{2}} \\ &= [(1/N)\{V\,SCAN^2 + NV\,DATA^2 + 2VSCAN\ VDATA\}]^{\frac{1}{2}} \end{aligned}$$

$$\begin{aligned} (VPIXEL\ \text{"off"})_{rms} &= \{(1/N)(VSCAN + VDATA)^2 + (N-1)(1/N)(VDATA)^2\}^{\frac{1}{2}} \\ &= [(1/N)\{V\,SCAN^2 + NV\,DATA^2 + 2VSCAN\ VDATA\}]^{\frac{1}{2}} \end{aligned}$$

The display of black and white are performed as described above. Next, the case of displaying an intermediate tone (gray) will be described.

Conventional Addressing Mode PWM Method Adapted for Gray Level

The signal applied to the rows are the same as before. Also, the maximum level for the signal applied to the columns is the same. For example, black corresponds to "off" and white corresponds to "on". Here, however, the period of applying the maximum level is changed.

Figure 6A:
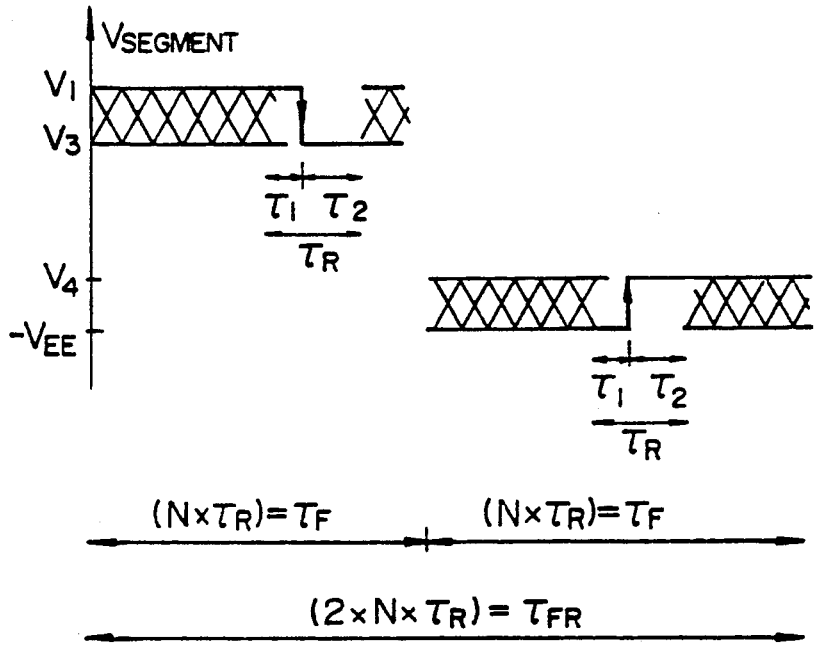
FIG. 6(A) (PRIOR ART)
FIGS. 6(A) and 6(B) show voltage waveforms applied to a dot matrix liquid crystal display according to a conventional pulse width modulation addressing mode.

The segment signal applied to a column of displaying the gray level is shown in the waveform of FIG. 6(A). During the selection time $\tau R$, the segment electrode receives the signal (V1, −VEE) of larger absolute value for a period of $\tau 1$, and the signal (V3, V4) of smaller absolute value for the remaining period $\tau 2$.

Here, the ratio $\tau 1/\tau R$ may be changed from 0 to 1 to represent the intermediate (gray) level from black to white.

Figure 6B:
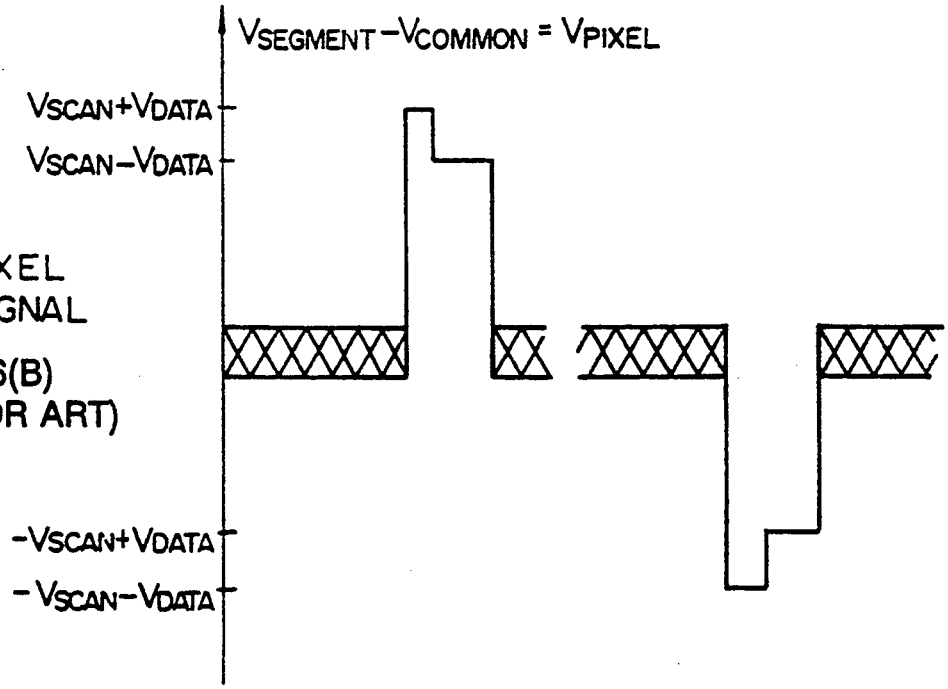
FIG. 6(B) (PRIOR ART)

The waveform of FIG. 6(B) represent the pixel voltage applied to each pixel by the common signal of the waveform of FIG. 4(A) and the segment of waveform of FIG. 6(A).

The root mean square of the pixel voltage becomes, for example, as follows.

When $\tau 1 = 0$ $$(VPIXEL)_{rms} = [(1/N)\{VSCAN^2 + NVDATA^2 -$$

-continued $$2VSCAN\,VDATA\}]^{\frac{1}{2}}$$

When $\tau 1 = \tau R$ $$(VPIXEL)_{rms} = [(1/N)\{VSCAN^2 + NVDATA^2 + 2VSCAN\,VDATA\}]^{\frac{1}{2}}$$

When $\tau 1 = \tau (0 < \tau < \tau R)$ $$(VPIXEL)_{rms} = [(1/N)\{VSCAN^2 + NVDATA^2 + \{2(2\tau - \tau R)/\tau R\}VSCAN\,VDATA]\}^{\frac{1}{2}}$$

Problems Encounted in Using PWM Method in the Conventional Addressing Mode

Figure 7A:
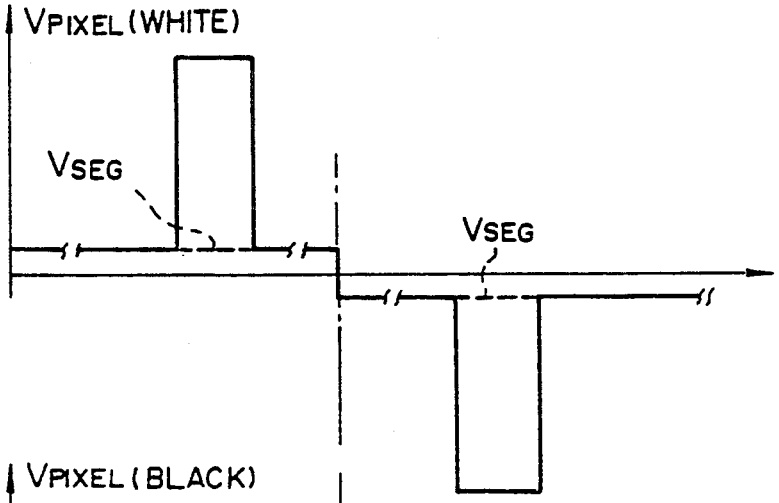
FIG. 7(A) (PRIOR ART)
FIGS. 7(A), 7(B), 7(C) show pixel voltage waveforms according to a conventional pulse width modulation addressing mode.
Figure 7B:
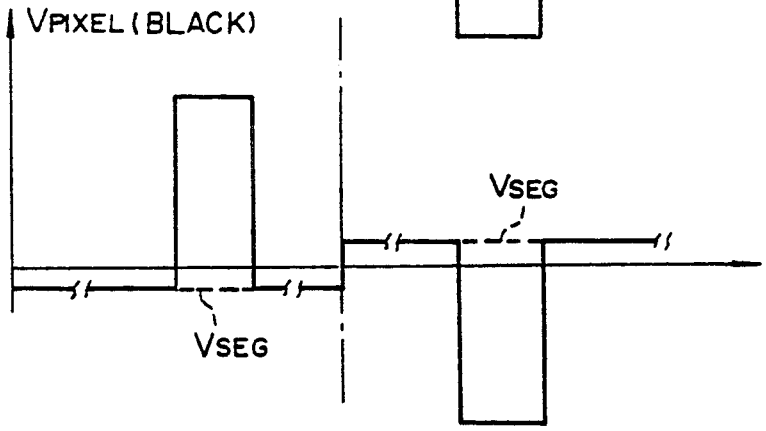
FIG. 7(B) (PRIOR ART)
Figure 7C:
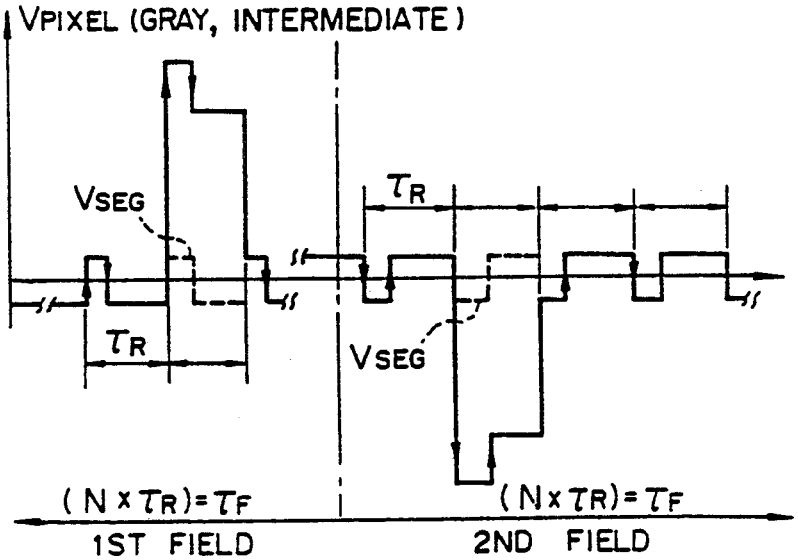
FIG. 7(C) (PRIOR ART)

Let us consider the effective pixel signal during the total frame time $\tau$FR for the following respective cases. The polarity reversal accompany with the change of the pixel signal will be considered hereinbelow. Here, however, the polarity reversal referred to above is the reversal of the polarity of the segment signal with respect to the common signal in the non-selected period (V2 or V5). FIGS. 7(A)-7(C) show the pixel signals which the pixel receive for the following three cases:

Case a: totally white pattern (FIG. 7(A));

Case b: totally black pattern (FIG. 7(B)); and

Case c: totally gray pattern (FIG. 7C).

In FIGS. 7(A)-7(C) the segment signal VSEG is shown in broken line.

Case a of FIG. 7(A) shows when the whole display surface is white. For displaying white, the segment signal is V1 in the first field and −VEE in the second field and the common signal changes from field V2 to −VEE in the first field and from V5 to V1 in the second field as shown in FIGS. 4(A) and 4(B). Thus, the pixel signal VPIXEL=VSEGMENT−VCOMMON is V1−V2=VDAT in the non-section time and V1−(−VEE)=VSCAN+2VDATA in the non-selection time in the first field and changes the polarity in the second field.

Case b of FIG. 7(B) represents the totally black pattern. For display black, the segment signal is V3 in the first field and V4 in the second field and the common signal is similar to the above described Case a as shown in FIGS. 4(A) and 4(B). The pixel voltage VPIXEL is V3−V2=−VDATA in the non-selection time and V3−(−VEE)=VSCAN in the selection time in first field and changes the polarity in the second field.

In the cases a and b, since all the rows are white or black, the segment signal in the field is the same for all the pixels, and the column signal experiences the polarity reversal once at the end of each field.

In he case c, of FIG. 7(C), the segment signal is a mixture of the case a and case b. The common signal is similar to the cases a and b, changing from V2 or V5 to −VEE or V1 only in the selection time. In this selection time, the segment signal becomes white state for a predetermined period and becomes black state for the remaining period. Since the selection time is sufficiently short, the observer recognizes these state as an abaredge.

The segment signal rises once and falls once in each selection time $\tau$R. Here, two polarity reversals arise. At the end of the field, one polarity reversal is omitted. Therefore, the column signal experiences (2N−1) polarity reversals in each field.

Figure 8A:
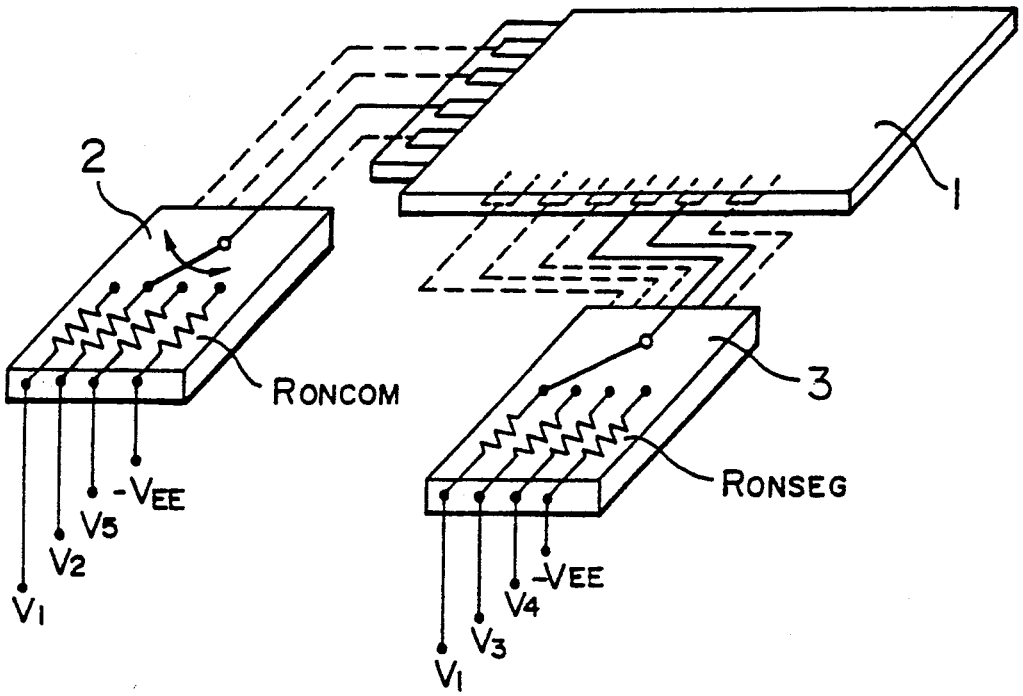
FIG. 8A (PRIOR ART)
FIGS. 8A and 8B illustrate the driving mechanisms for a dot matrix display.
Figure 8B:
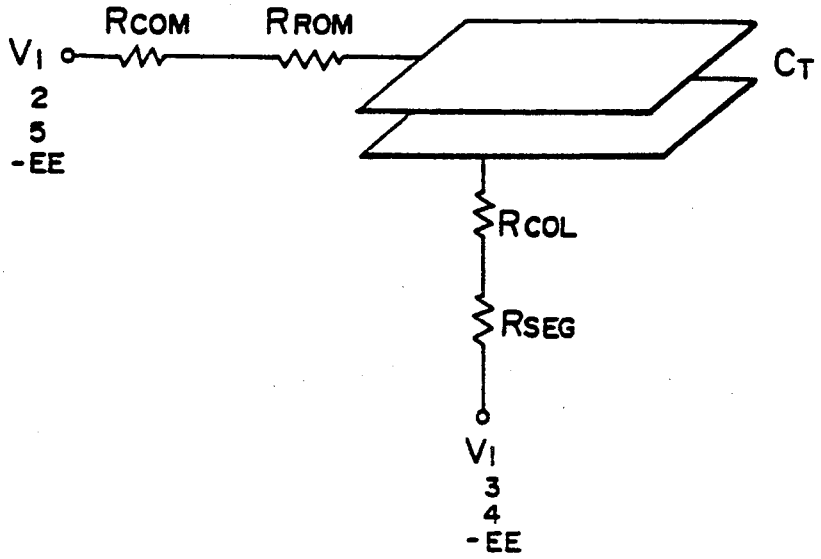
FIG. 8B (PRIOR ART)

FIGS. 8A and 8B show an equivalent circuit for the liquid crystal cell and the drivers in the case of displaying uniform white or black and uniform gray. As shown in FIG. 8A, a common driver 2 is connected to the rows and the segment driver 3 is connected to the columns of LCD. The LCD 1 has an internal resistance and parasitic capacitance. The common driver 2 and the segment driver 3 are supplied with the voltages V1, V2, V5, and −VEE and V1, V3, V4, and −VEE, respectively. Here, each voltage supply line has its resistance.

Each internal resistance of the common driver is denoted RON COM, the resistance of the row electrode Relectode row, the internal resistance of the segment driver RON SEG, the resistance of the segment electrode Relectode column and the total capacitance of the liquid crystal call CT. The resistances RON COM and the resistances Relectode row are connected in series to one electrode of the capacitance CT, and the resistance RON SEG and the resistances Relectode column are connected in series to the other electrode of the capacitance CT.

In the case of a uniform pattern, all the segment drivers supply the same signal, for example, V1 as shown in FIG. 8A.

When a row is not selected, all the common drivers supply a same signal, for example, V2 as shown in FIG. 8A.

In this case, considering the LCD panel as one capacitor, it can be approximated that all the common drivers are connected in parallel, as shown in FIG. 8B and all the segment drivers are also connected in parallel. Here, although the row line and the segment line changes its resistance according to the position of the pixel, a parallel connection of resistances each having the average resistance Relectrode/2 is assumed.

In this case, a typical access time $\tau$ for an applied signal is $$\begin{aligned} \tau &= RC \\ &= (RCOM + RSEG + RROW + RCOL) \times CT. \end{aligned}$$

where,

RCOM=RCOM/NCOM (NCOM being the number of rows).

RSER=RON SEG/NSEG (NSEG being the number of columns).

RROW=(Relectrode row /2)/NCOM, and

RCOL=(Relectrode column /2)/NSEG.

In the case of an LCD panel having a diagonal length of 10 inches, typical values are

RCOM≃500/400 Ω≃1.25 Ω.

RSEG≃1000Ω/640≃1.50Ω.

RROW≃(3 KΩ/2)/400≃4 Ω.

RCOL≃(2 KΩ/2)/640≃1.5Ω, and

CT=(1/367109)×5×{(20×15)/5×10)}=ε0×εLC-×cell area/gap)≃0.3 μF.

In this case, access time $\tau$=RC=8.25Ω×0.3 μF=2.5 μsec.

Typically, the length of one selection time $\tau$R is about 50 μsec, and the frame time is about 2 msec. In the cases a and b (uniform white and uniform black), the polarity reversal occurs once a frame time and the signal decay by the above time constant may be neglected. In the case c (uniform gray), the polarity reversal occurs twice a selection time, and the signal decay by the above-mentioned time constant cannot be neglected.

As the visual effect, all the intermediate gray pattern may appear darker than the true black.

For displaying intermediate gray tones in a large LCD, the PWM method is not appropriated in the conventional addressing mode.

Improved Addressing Mode

In the improved addressing mode, the number of polarity reversal is made the same for any uniform pattern display. In the conventional addressing mode as described above, there is no polarity reversal in the non-selection time for the cases of uniform white and black display, whereas there are many polarity reversal only in the uniform gray display.

Figure 9A:
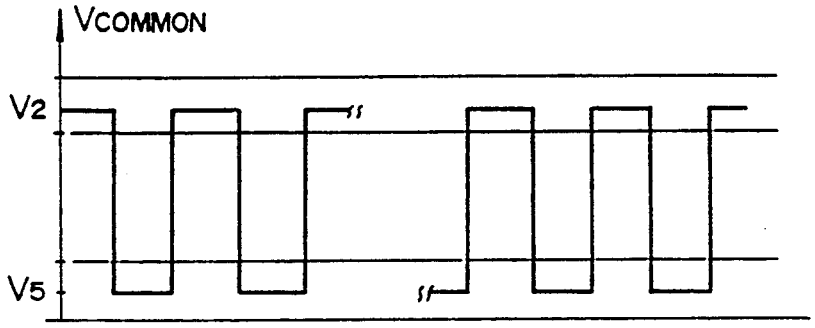
FIGS. 9(A), 9(B), 9(C) show signal waveforms illustrating an improved addressing mode.
Figure 9B:
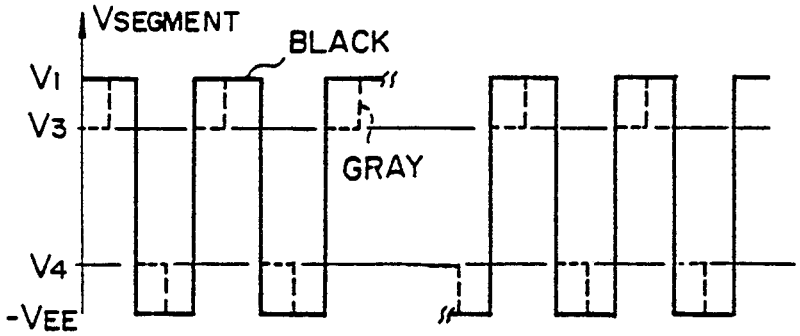
Figure 9C:
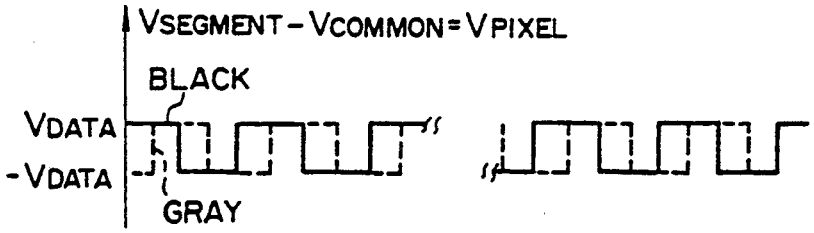

FIGS. 9(A)-9(C) show the waveforms of common signal (FIG. 9(A)), segment signal (FIG. 9(B)), and pixel signal (FIG. 9(C)) for the improved addressing mode. The common signal (FIG. 9(A)) alternately changes from V2 to V5, and rom V5 to V2 in the first field, and from V5 to V2 and from V2 to V5 in the second field, even in the non-selected time. The segment signal (FIG. 9(B)) changes between V1 and V3 which are on the both sides of the common signal voltage V2 and between V4 and −VEE which are on the both sides of the common signal V5, and performs the polarity reversal at each selection time. Therefore, the pixel signal (FIG. 9(C)) alternately changes between VDATA and −VDATA even outside the selection time for the designated row.

Even in the cases of black and white, one polarity reversal occurs at the end of each selection time for the respective rows. The signal pattern is inverted for the cases of black and white. In the case gray display, one polarity reversal occurs at an intermediate position of the respective selection time.

As the result, the number of polarity reversal becomes the same for any uniform pattern from black to white. The polarity reversal which appeared in the conventional addressing mode at the end of the each field is suppressed. Thus, the total number of the polarity reversal in each field for any uniform pattern becomes N−1. The number of polarity reversal for the conventional addressing mode and the improved addressing mode is summarized in the following table.

| Addressing Mode | Number of Polarity Reversal/Field | Display Pattern (Uniform) |
|---|---|---|
| conventional | 1 | white |
| (one polarity | 1 | black |
| reversal at the end of each frame) | | |
| +PWM | 2N − 1 | gray |
| improved | N − 1 | white |
| (polarity | N − 1 | black |
| reversal at each line) | | |
| +PWM | N − 1 | gray |

N being the number of rows to be successively scanned.

Problems Encountered in the Improved Addressing Mode with PWM

Method

In the improved addressing mode, the polarity reversal occurs one per each line for any grade display. In the case of a uniform pattern along a column (for example, a vertical stripe, the number of polarity reversal is the same for any arbitalily level from black to white.

Nevertheless, crosstalk occurs. The main reason is that a noise is induced on the common signal line by the changes of the segment signal.

Let us consider one row on the panel in the non-selection time. The noise on the common signal line for the two extream and yet practical cases may be analyzed as follows:

Case a (FIG. 10): uniform gray pattern, and

Case b (FIG. 11): black and white pattern changing alternately in the row direction.

For simplifying the analysis, the access resistance on the segment side is neglected. The basic mechanism of the crosstalk to be analyzed does not change by this simplification.

Figure 10:
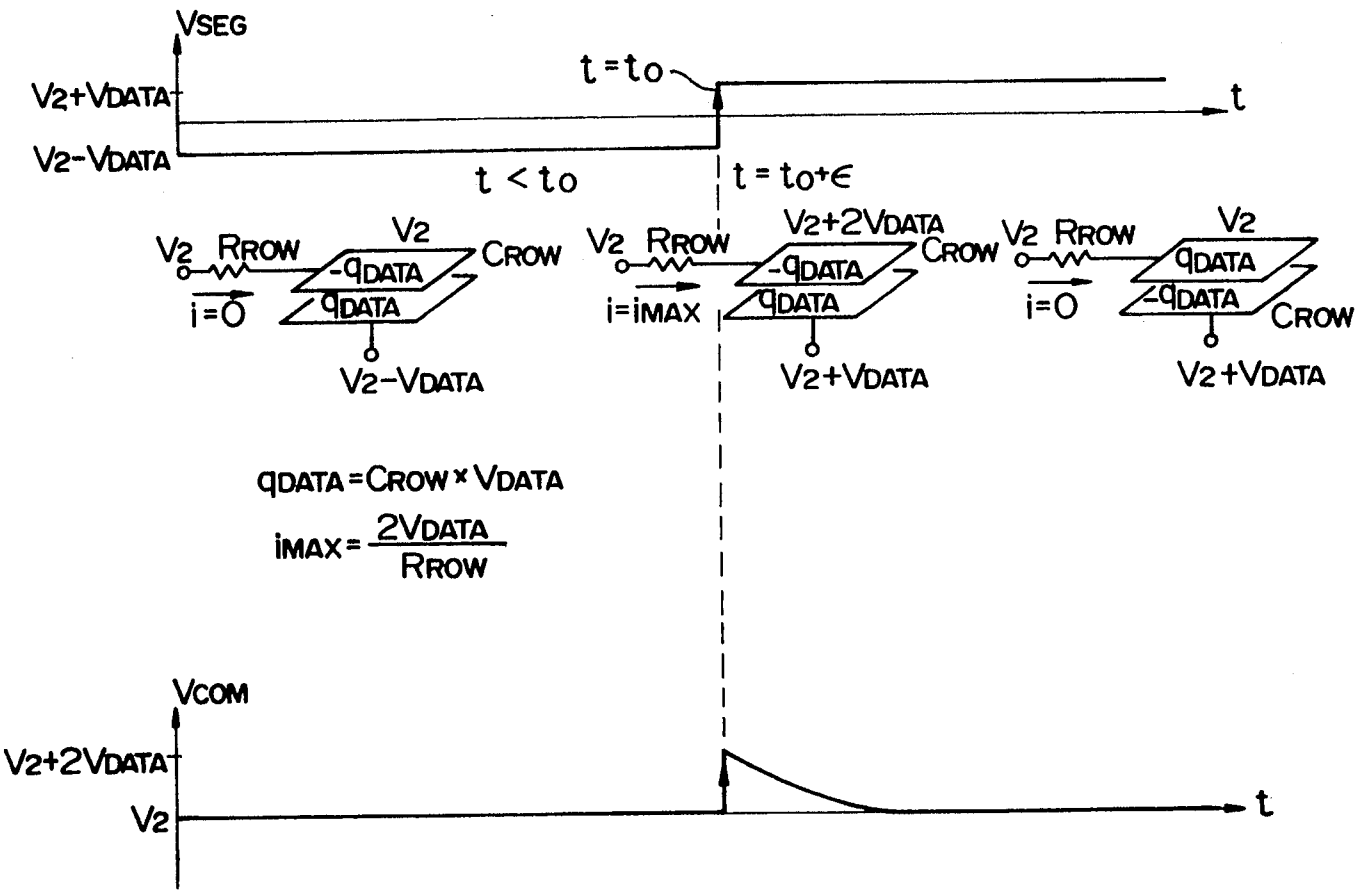
FIG. 10 illustrates noise generation on the common signal line when a dot matrix liquid crystal display displays a uniform pattern.

Referring to FIG. 10, let us consider the uniform gray pattern. It is assumed that a switch command is issued for all the segment drivers at t=t0. The segment signal changes from V2−VDATA to V2+VDATA. The common signal voltage is kept at V2.

Since the capacitor CROW stores the charge for establishing the voltage difference before this change, this voltage difference does not vanish at once unless the stored charge disappears. Just after the voltage change, $t=t0+\epsilon$, the voltage of the electrode of the capacitorCROW becomes as follows due to the charges stored theretofore.

Segment side: (instead of V2−VDATA) V2+VDATA,

Common side: (instead of V2) V2+2VDATA.

Since the common voltage is kept at V2, there is generated a voltage difference 2VDATA across the access resistance RROW. Thus, discharge begins through the access resistance and the discharge current i takes the maximum value at $t=t0\epsilon$ $$i(t0+\epsilon)=iMAX=2VDATA/RROW.$$

The voltage on the common signal line after t0 becomes $$V(\epsilon)=2VDATA \exp\{-(t-t0)/(RROW\cdot CROW\}.$$

Thus, the maximum amplitude of the noise is −2VDATA. The decay constant of the parasitic pulse is RROW×CROW. When a sufficient time elapses after t0, V=0.

Figure 11:
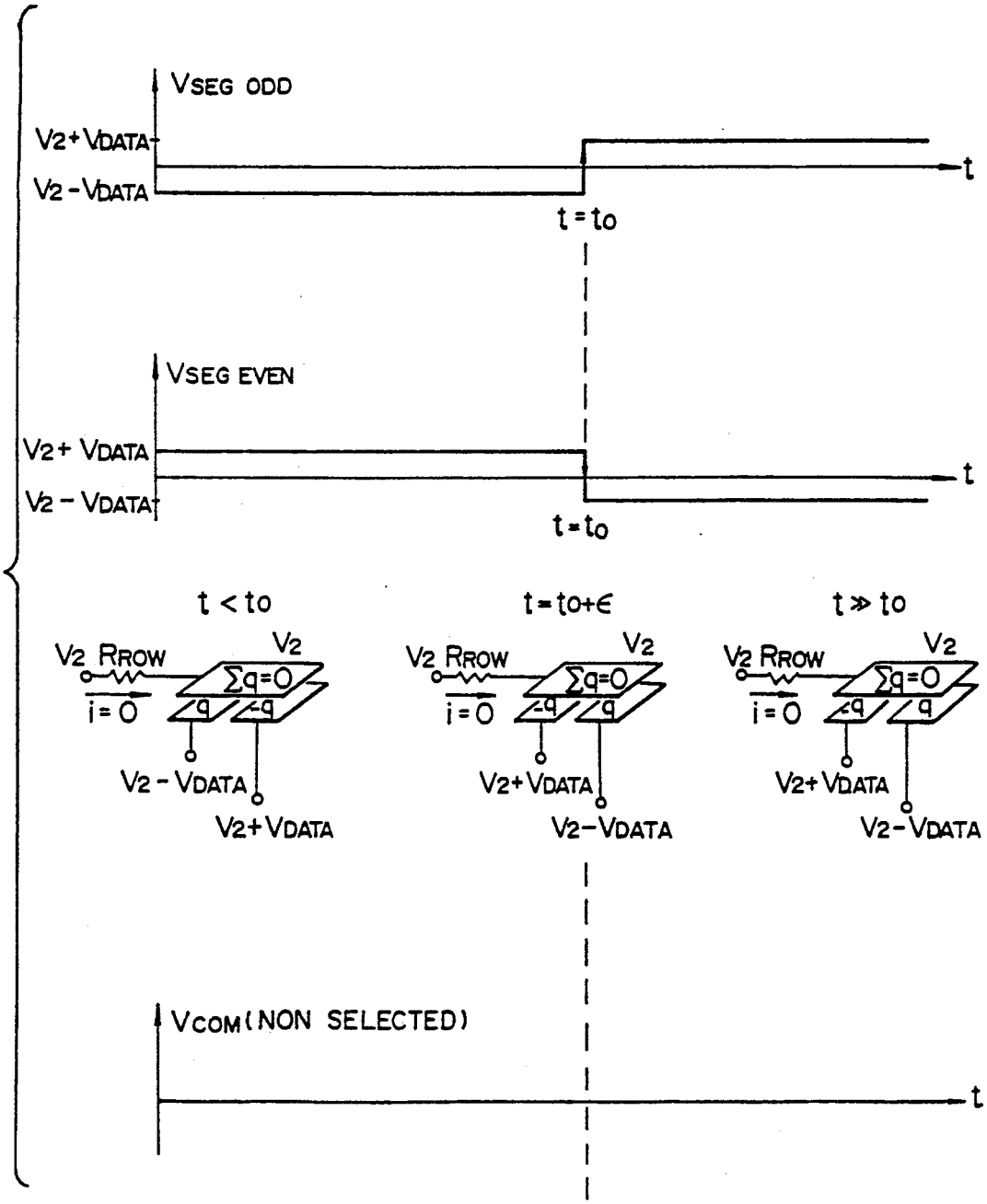
FIG. 11 illustrates noise generation on the common signal line when a dot matrix liquid crystal display displays alternating black and white pattern.

Next, referring to FIG. 11, horizontally alternate black and white pattern (vertical stripe) will be analyzed.

The pixel signal changes at t=t0 for each selection time from V2−VDATA to V2+VDATA for all the odd number columns, and from V2+VDATA to V2−VDATA for all the even number columns. Since the voltage changes for the two adjacent segment are opposite in sign and same in magnitude, the total charge on the row line side for the row capacitor (common side) is unchanged and is kept 0. Therefore, there is no noise induced on the common signal.

As a result, when PWM method is combined with the improved addressing mode, crosstalk due to the difference in the number of the polarity reversal is effectively improved, but the crosstalk induced on the common side circuit still appears.

Conventional Addressing Mode Utilizing 4-Level Power Source

Figure 4C:
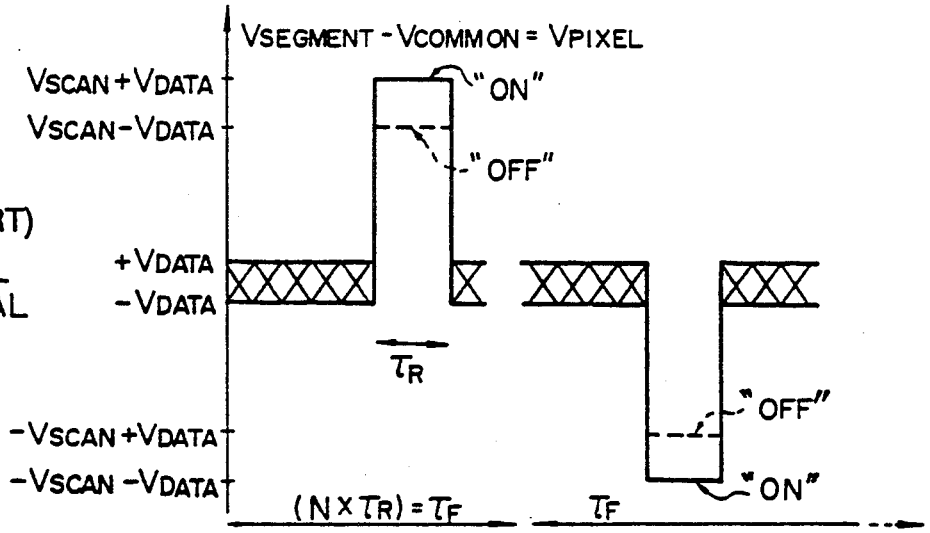
FIG. 4(C) (PRIOR ART)

The conventional addressing mode works on 6-level supply voltages as shown in FIGS. 4(A)–4(C). Namely, a 6-level voltages are:

V1, V3, V4, −VEE for the segment, and

V1, V2, V5 and −VEE for the common electrodes.

The maximum voltage amplitude which the liquid crystal cell receives is VSCAN+VDATA, which is equal to the maximum voltage difference V1−(−VEE) of the power source.

Figure 5A:
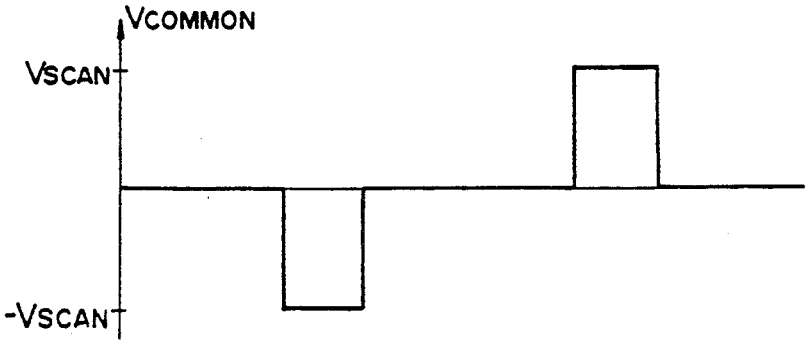
FIG. 5(A) (PRIOR ART)
FIGS. 5(A), 5(B), 5(C) show voltage waveforms applied to a dot matrix liquid crystal display according to another conventional addressing mode using a 4-level power source.
Figure 5B:
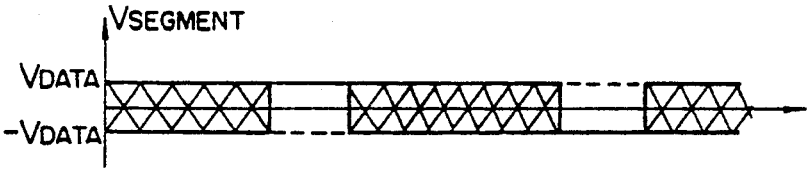
FIG. 5(B) (PRIOR ART)
Figure 5C:
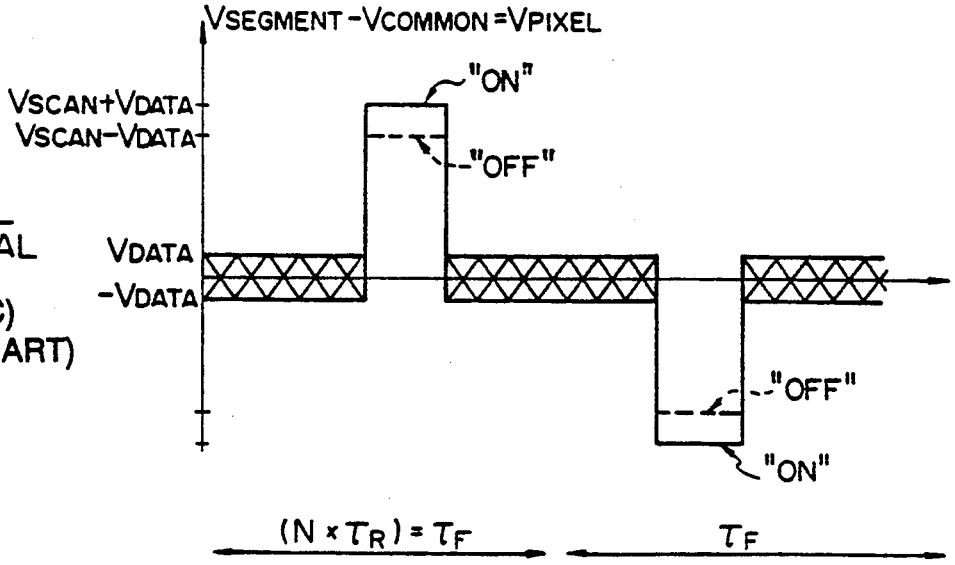
FIG. 5(C) (PRIOR ART)

FIGS. 5(A)–5(C) illustrate an alternative power source plan for the driver and the power source. In this case, only four levels are required for the power source except the ground level. The common voltage is swinged positive and negative from the ground potential, and the segment voltage is swinged between +VDATA and −VDATA.

When the maximum voltage difference of the power source is large and 2SCAN, the maximum voltage amplitude which the liquid crystal cell receives is VSCAN+VDATA. The peak value of the voltage applied to the common driver becomes large and is 2VSCAN.

In case when 4-level power source is employed in place of a 6-level power source, the voltage received by each pixel effectively does not change.

The problems encountered are similar and the counter measures are also similar. We would like to mention this type of power source because the power source becomes more cheap when employing this type.

Now, description will be made on the embodiments of the present invention.

According to an embodiment of this invention, a current supplied by the segment power source is detected through a small series resistance or the like. The voltage established on each resistance is inverted and amplified by a conventional inverter amplifier. The signal supplied from the inverter amplifier is fed back to the output line of the common power source corresponding to the non-selected state. For example, the signal is applied to a capacitor connected to the input line of a common driver. These output lines are provided with resistance as well as capacitances.

In this way, when the segment electrodes are totally switched, the effective currents supplied to the common electrodes opposing to said segment electrode are increased significantly.

As a result, the decay of a parasitic pulse on the common signal line also decreases significantly. When the common signal is noise-free, cross talk is reduced. Then, it is appropriate to employ the PWM method for displaying the gray level which has no limitation on the number of levels by the drive mode. Then, polarity reversal occurs once at the end of each line.

According to an aspect of this invention, cross talk when a multiplicity of gray levels are displayed can be reduced by using the PWM method.

This method can be combined with any type of drivers, and does not need additional parts for the cell itself.

Conventional driver circuit and the LCD cell can be utilized. It is only needed to add a feedback system incorporated in the power source board. Thus, a wide costup can be prevented and the effect on the manufacturing costs is small. Any types of dot matrix LCD can be employed, such as twisted nematic (TN), super twisted nematic (STN), color super homeotropic (CSH), FLC.

In the Case of Ordinary 6-Level Power Source

Figure 1:
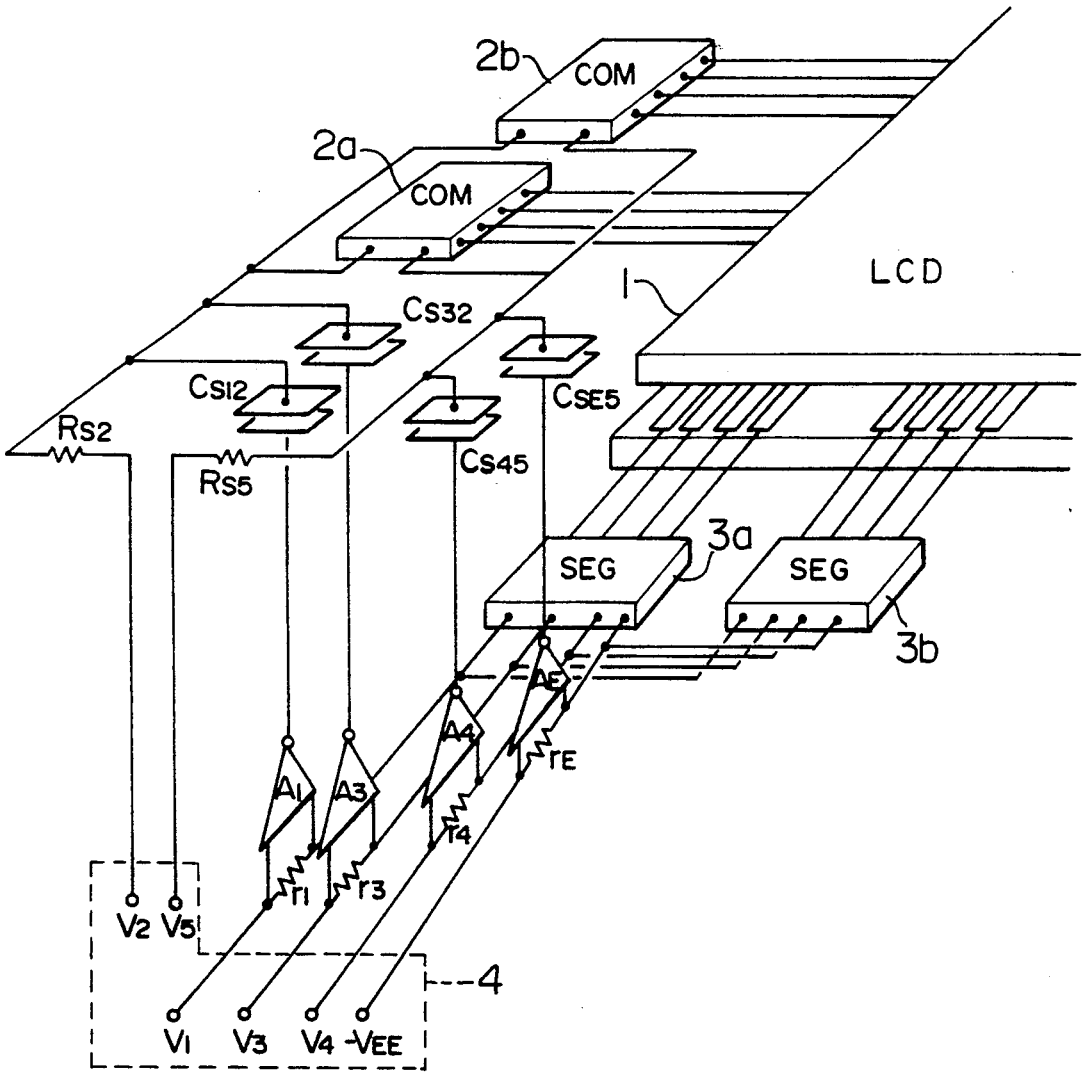
FIG. 1 is a schematic diagram showing a 6-level power source for a dot matrix liquid crystal display according to an embodiment of this invention.

FIG. 1 shows a feedback system for an ordinary dot matrix LCD equipped with a conventional common driver and a segment driver, and a feedback system incorporated on the standard type 6-level power source board supplying V1, V2, V3, V4, V5 and −VEE. In FIG. 1, two common drivers 2*a* and 2*b* and two segment drivers 3*a* and 3*b* are connected to an LCD cell 1, as a general construction.

A standard 6-level power source 4 supplying V2 and V5 for the common drivers and V1, V3, and V4 and −VEE for the segment drivers, is connected to the common drivers 2*a* and 2*b* and to the segment drivers 3*a* and 3*b* for supplying the electric power. These structures are similar to those in the conventional art.

In the structure of FIG. 1, the following new elements are connected between the power source 4 and the common drivers 2*a* and 2*b* and the segment drivers 3*a* and 3*b*.

Protection resistors RS2 and RS5, for example, each of 1KΩ, are connected in series in the output line for the supply voltages V2 and V5. Sensor resistors r1, r3, r4 and rE are respectively connected in series in the bus lines of the voltages V1, V3, V4 and −VEE. An inverter amplifier A1 has its input terminals connected across the sensor resister r1, and supplies an inverted and amplified output. Similarly, inverter amplifiers A3, A4 and AE have their respective input terminals connected across the sensor resistors R3, R4 and RE and supply the inverted amplified outputs. A capacitor CS12 is connected between the output terminal of the amplifier A1 and the bus line of the voltage V2. Similarly, a capacitor CS32 is connected between the amplifier A3 and the bus line of the voltage V2. Capacitors CS45 and CSE5 are connected between the amplifiers A4 and AE and the bus line of the voltage V5.

When a current flows through a sensor resister, there occurs a voltage drop in the sensor resister. The amplifiers A1, A3, A4 and AE having an amplification factor α pick up these voltage drops and supply the following voltages.

A1:Va−αilrl,

A3:V3−αi3r3,

A4:V4−αi4r4, and

AE:−VEE−αiErE, where i1, i3, i4 and iE are currents flowing through the sensor resistors r1, r3, r4 and rE.

Further, it is selected that r1=r3=r4=rE=rsensor, and

CS12=CS32=CS45=CE5=CS.

For example, the sensor resistance rsensor is about 0.1Ω and the sensor capacitance CS is about 0.3 μF.

When the segment voltage is to change, one of the segment voltages V1, V3, V4 and −VEE is selected as a new voltage and connected to a segment electrode. Then, a current flows through one of the sensor resistors r1, r3, r4 and rE to charge the segment electrode to establish a desired voltage. The current through the sensor resister r is picked up and amplified by the amplifier A and supplied to corresponding one of the capacitors CS12, CS32, CS45, and CSE5. Then, the counter electrode of the capacitor CS will get a similar, but opposite ensign, change, which can work as a sub-current source.

Figure 3:
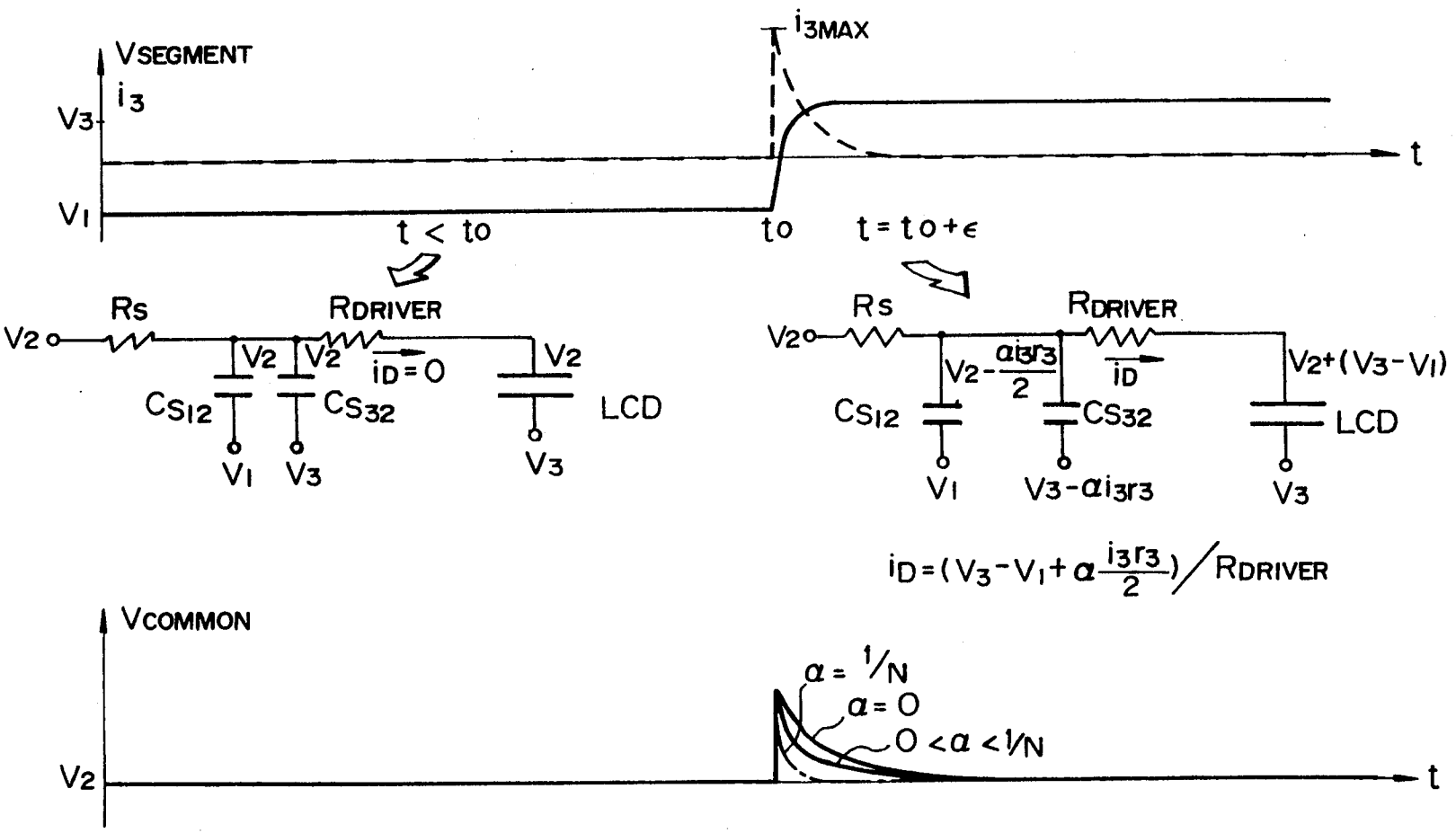
FIG. 3 is a diagram for illustrating the basic operation of the liquid crystal display according to the embodiments of this invention.

It will be easily understood how the feedback system as shown in FIG. 1 is effective for the reduction of the noise on the common signal line, when referring to FIG. 3.

FIG. 3 shows the segment voltage waveform and the common voltage waveform in the case of displaying gray. For displaying gray, the common electrode is to be held at V2 and the segment electrode is changed from V1 to V3. Upon the voltage change on the segment line, there occurs a voltage change also on the common electrode.

Assuming that the voltage change on the segment electrode occurs at t=t0. Just after t0, i.e. t0+ϵ, the voltage bus line for the voltage V3 supplies a current 13 for changing the voltage of the segment electrode from V1 to V3. This current waveform is shown by a broken line in the upper part of FIG. 3. Upon the current flow of 13 through the sensor resister r3 (cf FIG. 1), there arises a voltage drop i3×r3 across the sensor resister r3. The amplifier A3 receives V3 on one input terminal and V3−αi3r3 on the other input terminal, and supplies an output proportional to i3r3. The common electrode connected to the voltage bus line of V2 receives the voltage change of the segment electrode, (V3−V1) and the voltage change from the additional circuit, −αi3 r3. Thus, the current flowing through the resistance of the common driver is $$iD = [\{V2(V3 - V1)\} - V2 - (\alpha i3\ r3/2)]/RDRIVER, \quad (1)$$
$$iD = (V3 - V1)/RDRIVER + (\alpha i3\ r3/2)/RDRIVER.$$

This current is to be compared with the conventional one, $$(iD)\ CONVENTIONAL = (v3 - v1)/RDRIVER$$

Also, it will be understood that the total current supplied by the power source V3 is equal to the sum of the total current through the non-selected common drivers and the current through the selected common driver.

$$i3 \simeq Nid. \quad (2)$$

From the relations (1) and (2)

$$id[1 - (N\alpha rsensor/2RDRIVER)] = (v3 - V1)/R\text{-}DRIVER.$$

Basically, when $\alpha = (2 \times RDRIVER)/(N \times rsensor)$, there is a tendency that the effective common side resistance approaches 0 after the change at t0.

Practically, the delay time of the amplifier should be considered.

By reducing the noise on the common signal bus, cross talk due to the polarity reversal of the segment signal can be suppressed.

PWM method becomes appropriate for displaying gray level in a large size LCD without any limitation on the number of levels.

Case of 4-Level Power Source

Figure 2:
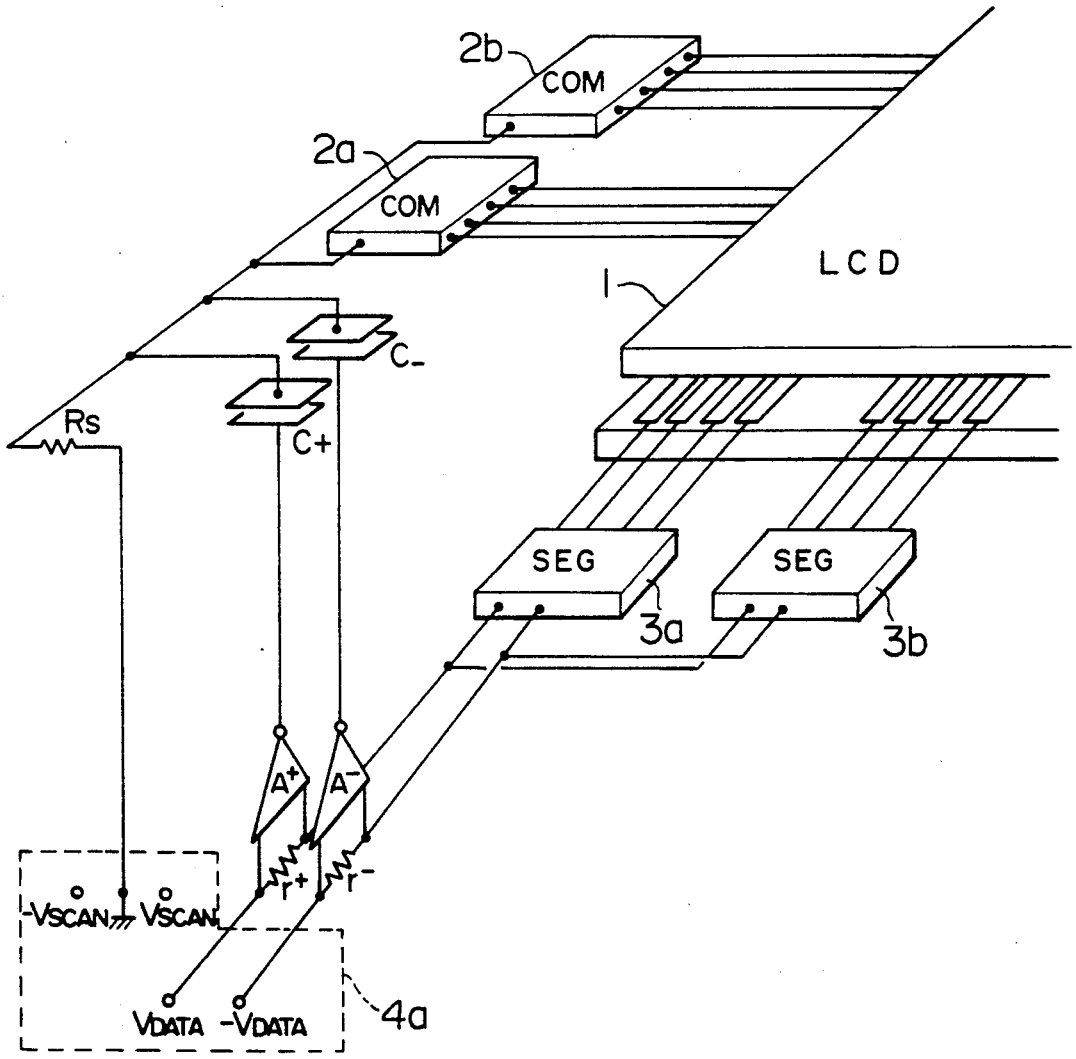
FIG. 2 is a schematic diagram showing a 4-level power source for a dot matrix liquid crystal display according to another embodiment of this invention.

FIG. 2 shows an ordinary dot matrix LCD having a common driver and a segment driver, and a feedback system incorporated in the board of a 4-level type power source 4a which supply −VSCAN, +VSCAN, VDATA, and −VDATA.

Common drivers 2a and 2b receive the ground potential through a series protection resistor RS, which is, for example, 1KΩ. Segment drivers 3a and 3b receive the voltages of +VDATA and −VDATA through sensor resistor $r^+$ and $r^-$. Inverter amplifiers $A^+$ and $A^-$ have their input connected across the sensor resisters $R^+$ and $r^-$. Capacitors $C^+$ and $C^-$ are connected between the ground voltage bus line and the output of the inverter amplifiers $A^+$ and $A^-$. It is selected that $$r^+ = r^- = rsensor \text{ (for example } 0.1\Omega).$$

$$C^{+]} = C^{=} = C \text{ (for example } 0.3\ \mu F).$$

and amplifiers $A^+$ and $A^-$ have an amplification factor α.

Then, the amplifiers $A^+$ and $A^-$ supply the following voltages:

$$A^+: +VDATA - \alpha i^+ r^+,$$
$$A^-: -VDATA - \alpha i^- r^-$$

where $i^+$ and $i^-$ are current flowing through the sensor resistors $r^+$ and $r^-$.

Similar to the preceding embodiment, when the voltage of a segment electrode is changed, the voltage change is detected and fed back to the common electrode. The capacitor $C^+$ and $C^-$ serves as subsidiary power sources for the common electrode.

In the case of 4-level power source, the structure of the feedback system becomes simpler and of lower manufacturing cost.

As is described above, according to the embodiments of this invention, dot matrix LCD's of low noise and low crosstalk can be provided.

Although description has been made on preferred embodiments of this invention, the present invention is not limited thereto. For example, it will be apparent for those skilled in the art that various alterations, substitutions, changes, improvements and combination thereof are possible within the scope and spirit of the appended claims.

I claim:

1. A power source for a dot matrix liquid crystal display having segment electrodes and common electrodes, comprising:
   - a segment driver for supplying picture signals to the segment electrodes;
   - a common driver for successively energizing common electrodes;
   - a segment driver power source for supplying predetermined power to said segment driver;
   - a common driver power source for supplying predetermined power to said common driver; and
   - feed-back means for detecting currents supplied from said segment driver power source to said segment driver, inverting and amplifying detected currents, and injecting amplified currents to said common driver.

2. A power source for a dot matrix liquid crystal display according to claim 1, wherein said feed-back means includes capacitance elements coupled to outputs of said common driver power source.

3. A power source for a dot matrix liquid crystal display according to claim 1, wherein said feed-back means includes resistance elements serially connected to outputs of said segment driver power source.

4. A power source for a dot matrix liquid crystal display according to claim 3, wherein said feed-back means further includes capacitance elements coupled to outputs of said common driver power source, and inverting amplifiers respectively connected to said resistance elements for picking up voltage drops in said resistance elements and supplying amplified outputs to said capacitance elements.

5. A power source for a dot matrix display according to claim 4, wherein said feed-back means further includes protection resistors connected between said common driver power source and said capacitance elements.

6. A power source for a dot matrix liquid crystal display according to claim 1, wherein said power source supplies 6-level voltages.

7. A power source for a dot matrix liquid crystal display according to claim 1, wherein said power source supplies 4-level voltages.

8. A power source for a dot matrix display according to claim 4, wherein said inverting amplifiers have an amplification factor $\alpha=(2\times\text{RDRIVER COMMON})/(N\times\text{rsensor})$, where N is number of said common electrodes, RDRIVER COMMON is resistance of said common driver, and rsensor is resistance of said resistance elements.

* * * * *